US008733433B2

(12) United States Patent
Coles

(10) Patent No.: US 8,733,433 B2
(45) Date of Patent: May 27, 2014

(54) METHOD AND APPARATUS FOR PERFORMING CONTINUOUS TUBING OPERATIONS

(76) Inventor: Robert A. Coles, Lafayette, LA (US)

( * ) Notice: Subject to any disclaimer, the term of this patent is extended or adjusted under 35 U.S.C. 154(b) by 514 days.

(21) Appl. No.: 12/802,571

(22) Filed: Jun. 9, 2010

(65) Prior Publication Data

US 2010/0314132 A1 Dec. 16, 2010

Related U.S. Application Data

(60) Provisional application No. 61/268,750, filed on Jun. 11, 2009.

(51) Int. Cl.
*E21B 19/22* (2006.01)

(52) U.S. Cl.
USPC ..... 166/77.2; 166/77.1

(58) Field of Classification Search
USPC ..... 166/384, 77.2, 77.1; 242/166, 272, 273, 242/275, 397, 397.2, 397.3, 557
See application file for complete search history.

(56) References Cited

U.S. PATENT DOCUMENTS 3,116,793 A * 1/1964 McStravick ..... 166/285
3,809,334 A * 5/1974 Beurer et al. ..... 242/397.3
3,920,076 A * 11/1975 Laky ..... 166/384
4,249,600 A * 2/1981 Bailey ..... 166/77.2
4,345,855 A * 8/1982 Uyeda et al. ..... 405/168.3
4,673,035 A * 6/1987 Gipson ..... 166/77.1
4,730,677 A * 3/1988 Pearce et al. ..... 166/345
4,789,108 A * 12/1988 Recalde ..... 242/388.7
5,284,323 A * 2/1994 Pawkett ..... 254/134.3 SC
5,432,709 A * 7/1995 Vollweiler et al. ..... 702/32
5,575,332 A * 11/1996 Wasterval, Jr. ..... 166/77.1
5,765,643 A * 6/1998 Shaaban et al. ..... 166/384
5,950,953 A * 9/1999 Baugh et al. ..... 242/397.3
6,276,456 B1 * 8/2001 Head ..... 166/359
6,443,431 B1 * 9/2002 Stasny et al. ..... 254/385
6,454,014 B2 * 9/2002 Coats et al. ..... 166/384
6,691,775 B2 * 2/2004 Headworth ..... 166/77.2
6,932,553 B1 * 8/2005 Roodenburg et al. ..... 414/22.51
7,152,672 B1 * 12/2006 Gipson ..... 166/77.2
7,210,647 B2 * 5/2007 Dion ..... 242/397.3
7,311,151 B2 * 12/2007 Chitwood et al. ..... 166/367
2002/0074135 A1 * 6/2002 Headworth ..... 166/384
2003/0071160 A1 * 4/2003 Cain et al. ..... 242/390.5
2008/0265081 A1 * 10/2008 Laun et al. ..... 242/397.3
2011/0284234 A1 * 11/2011 Portman ..... 166/348

* cited by examiner

*Primary Examiner* — Giovanna Wright
*Assistant Examiner* — Michael Wills, III
(74) *Attorney, Agent, or Firm* — Ted M. Anthony

(57) ABSTRACT

A spool for deploying and retrieving multiple separate strings of continuous tubing, such as over the side of or through the moon pool of a boat, rig or other vessel, without the need of an injector head. The spool has at least one rotating swivel to permit pumping of fluid(s) down, or back up, tubing strings while the spool is rotating or stationary. A level-wind assembly having at least one sheave directs the continuous tubing overboard, but also level-winds the tubing onto the spool in an orderly fashion through lateral movement of the sheave. The system is powered by a hydraulic power unit with a remote control console.

5 Claims, 6 Drawing Sheets

METHOD AND APPARATUS FOR PERFORMING CONTINUOUS TUBING OPERATIONS

CROSS REFERENCES TO RELATED APPLICATION

Priority of U.S. Provisional Patent Application Ser. No. 61/268,750 filed Jun. 11, 2009 and Application Ser. No. 61/268,740 filed Jun. 16, 2009, both incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains for a method and apparatus for performing continuous tubing operations. More particularly, the present invention relates to a system for performing continuous tubing operations in connection with subsea wells and pipelines. More particularly still, the present invention pertains to a continuous tubing system that can be used to pump fluid(s) into subsea wells or pipelines, or that can accommodate fluid flow from said subsea wells or pipelines.

2. Brief Description of the Prior Art

Continuous tubing systems—commonly referred to as "coiled tubing units"—are well known by those having skill in the art of oil and gas operations. Such coiled tubing units, which often provide a viable alternative to conventional rig operations, typically employ a continuous length of flexible tubing rather than multiple sections of rigid pipe.

Coiled tubing can be used to conduct many different downhole operations in oil and gas wells. For example, coiled tubing can be concentrically inserted into an existing wellbore in order to clean out sand or other debris from such well. Further, conventional coiled tubing can be used to conduct downhole operations by attaching a fluid activated tool to the distal end of the tubing, and then pumping pressurized drilling fluid through the coiled tubing to actuate such tool. In the case of a mud motor and drill bit, the drill bit and hydraulic mud motor are lowered into the borehole as the coiled tubing is spooled off a reel, thereby allowing the borehole to be drilled deeper into subterranean formations.

A significant advantage of coiled tubing operations over conventional rig operations is that the coiled tubing can be raised and lowered in a borehole at rates up to ten times faster than those possible with conventional rig techniques. This increased speed is primarily attributable to the fact that coiled tubing can be "tripped" in and out of a borehole without screwing or unscrewing individual joints of pipe during the pipe running process. Put another way, continuous coiled tubing can be translated in and out of a wellbore without having to stop to add or remove individual joints of pipe.

During conventional coiled tubing operations, a continuous length of spooled tubing is typically translated into and out of a wellbore. In most cases, such flexible tubing is stored on a large reel that rotates about a substantially horizontal axis. The coiled tubing can be translated in and out of a wellbore in a virtually continuous manner using a pushing/pulling device known as an injector head.

Conventional injector heads typically utilize specially-adapted chain assemblies to grip the outer surface of the coiled tubing string. A hydraulic drive system provides power for running and retrieving the continuous tubing string into and out of a wellbore. In most cases, the base of the injector head is secured to wellhead pressure-control equipment, while a gooseneck assembly mounted on top of the injector head is often used to feed the tubing string from the reel around a controlled radius and into the injector head.

In most instances, the continuous tubing on the reel is connected to a swivel pump-in sub at one end, while the other end of said continuous tubing can be translated from said reel through the injector head and into a wellbore. Fluids can be pumped through said swivel pump-in sub and into the control bore of the continuous tubing string. During operation, the distal end of the continuous tubing can be translated into said wellbore using the injector head.

As the world's supply of easily accessible oil and gas reserves becomes depleted, significant oil and gas exploration and production operations have shifted to more challenging environments, including deep-water locations. Wells drilled on such locations are often situated in thousands of feet of water, which makes setting of conventional production platforms extremely difficult, if not impossible. In such cases, wells are frequently completed using "subsea" completions wherein the wellheads and related equipment are situated on the sea floor. An extensive array of flow lines are typically used to connect such subsea wells to floating production facilities, pipeline interconnection points and/or other subsea completions.

When servicing subsea wells and/or pipelines, it is often beneficial to insert a hose or other tubing concentrically within the wellbore and/or pipeline, especially to permit a flow path for fluid in said well or pipeline. If the water depth is such that use of a standard hose assembly is not feasible, coiled tubing units are sometimes used. However, conventional coiled tubing units in general, and injector heads in particular, are typically not well suited or cost effective for such uses. Thus, there is a need for an apparatus that can be used to deploy multiple strings of continuous tubing in a well or pipeline, including but not necessarily over the side of a marine vessel or through the moon pool of a vessel, without the need of a separate lifting or translating device such as an injector head.

SUMMARY OF THE PRESENT INVENTION

The present invention comprises an apparatus capable of deploying multiple lengths of continuous tubing in a well, pipeline or other similar environment. The tubing can be deployed in many different manners including, but not necessarily limited to, over the side of a vessel or through the moon pool of a drilling rig or other vessel, without the need of a separate lifting or translating device such as an injector head. In the preferred embodiment, the present invention can permit the simultaneous deployment and retrieval of two separate continuous tubing strings. Moreover, the present invention further enables simultaneous pumping through either or both strings, as well as simultaneous flow back through either or both strings, including during periods when such continuous tubing strings are moving or stationary.

In the preferred embodiment, the present invention comprises a spool assembly having a central drum. Said spool assembly is rotatable about a central axis; in most cases, said axis has a substantially horizontal orientation. At least one string of continuous tubing is reeled or spooled around the drum of said spool assembly. Further, said drum can be rotated through the use of hydraulic motor and gear assemblies. Such motor and gear assemblies permit rotation of said drum in both forward and reverse, as well as a separate braking system independent of the drive system to ensure the drum remains stationary when desired. The spool assembly beneficially has sufficient pulling capacity to deploy as well as retrieve the entire length of spooled tubing, as well as a variety of fluids that the tubing may contain without the help of any outside force(s) such as auxiliary winches or buoyancy devices.

In the preferred embodiment, the spool assembly of the present invention has at least two independent braking systems. The first is a disc and caliper system, while a secondary braking system is integrated in the hydraulic motors used to rotate the spool assembly drum. The spool assembly also has a counterbalance valve system used to keep the drum stationary when no hydraulic pressure is applied, thereby serving as an additional safety feature.

The system also includes a level-wind guide system. In the preferred embodiment, said level-wind guide system comprises a welded framework skid that supports at least two separate guide sheaves. Said guide sheaves direct the continuous tubing away from the winch drum and toward a desired use—such as, for example, over the side of a vessel or through the moon pool of a rig or other vessel. In addition to guiding the tubing from the winch and downward, the guide sheave also move side-to-side on support assemblies which cause the tubing strings to pay-out and take-up in an orderly fashion.

In the preferred embodiment, the movement of the sheaves from side to side is caused by actuation of hydraulic motors attached to lead screws that rotate through the center of the guide sheaves applying force to level-wind pawls that are attached to following carriers on the sheaves. The hydraulic motors are driven by fluid that is pumped from a hydraulic motor. The motor on the winch assembly is connected to the shaft on the main winch drum through the use of a chain drive system.

In the preferred embodiment, each revolution of the main drum moves the guide sheaves laterally a distance equal to the diameter of the string of tubing. In the event that it is necessary to manually control the side to side movement of a sheave or sheaves, a manual override system allows the user to bypass the winch mounted hydraulic motor supply for one or both sheave level-wind motors and use fluid power from the hydraulic power unit to manually actuate the level-wind motors and move the sheave(s) to the desired position(s) before reverting back to automatic operation.

In the preferred embodiment, the level-wind guide assembly of the present invention further comprises a trap roller assembly that can be lowered over each sheave to ensure that tubing does not exit a sheave groove. The trap roller assembly can be beneficially lowered with hydraulic cylinders. Stationary trap roller assemblies guide the continuous tubing, and also serve as a surface upon which a clamp placed around the tubing can rest underneath when tension is applied to the tubing in order to remove a tension weight and still keep the tubing in a controlled position. Said trap roller assembly also has multiple locations that can accommodate placement of a counter device to record the length of tubing deployed or retrieved.

Because the level-wind guide assembly is separate from the spool assembly, it affords great flexibility in placement of the spool assembly. If the level-wind and sheave were fixed to the spool assembly, a user would have to place the spool assembly near the entry point (i.e., the edge of the vessel or moon pool). With the present invention, only the level-wind assembly must be located in proximity to the entry point. Because the spool assembly is relatively heavy, this flexibility permits the spool assembly to be moved around a vessel as needed for ballasting purposes.

Further, because the level-wind guide is directly over the load, the level-wind action puts minimal side loading force on the tubing. Conventional level-wind systems apply force to the side of the tubing between the drum and between the load or sheave which requires much more force that can fatigue or even damage the tubing.

A hydraulic power unit driven by either an electric motor or diesel engine provides the power necessary to drive the main winch drum, brake system and level-wind guide sheave assemblies, as well as any other functions needed by the system. The control system is either mounted directly to the hydraulic power unit, is part of a remote operating panel, or a combination of the two. The control panel permits operation of every function of the system from a single point. The control panel also allows a user to connect and control additional spool and level-wind assemblies to the same panel, and control them independent of each other.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed.

DETAILED DESCRIPTION OF A PREFERRED EMBODIMENT OF THE INVENTION

As set forth above, the present invention comprises an apparatus capable of deploying multiple lengths of continuous tubing in wells, pipelines or other similar environments without requiring use of a separate lifting or translating device such as a conventional injector head or other similar equipment.

By way of illustration, but not limitation, the apparatus of the present invention permits simultaneous deployment of multiple strings of continuous tubing over the side of boats, through the moon pools of drilling rigs, and in connection with other vessels. In the preferred embodiment, the present invention can permit the simultaneous deployment and retrieval of multiple, separate strings of continuous tubing. Moreover, the present invention further enables simultaneous pumping through either or both strings, as well as simultaneous flow back through either or both strings, including during periods when the individual continuous tubing strings are moving or stationary. Further, if desired, fluid-actuated tools can be attached to the distal end of the lengths of continuous tubing.

Figure 1:
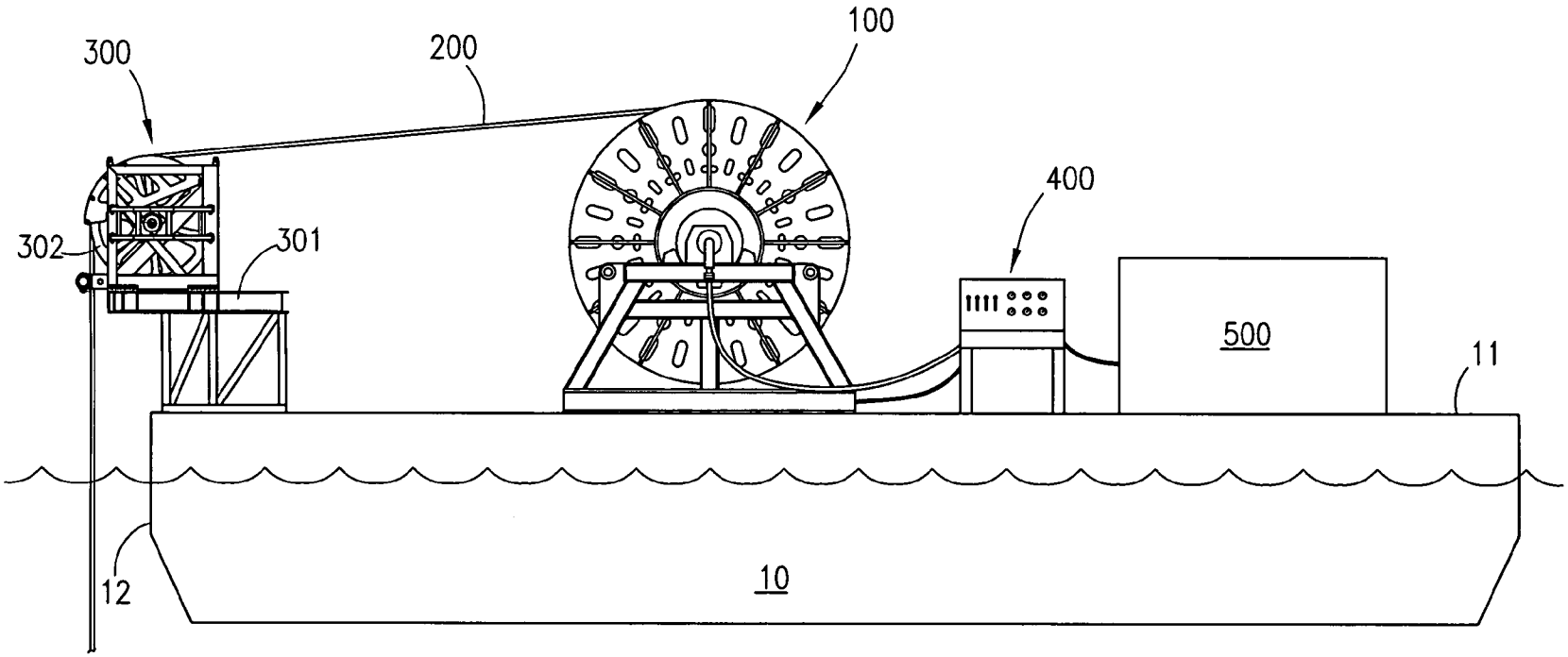
FIG. 1 depicts a side view of the continuous tubing apparatus of the present invention deployed on a marine vessel.

Referring to the drawings, FIG. 1 depicts a side view of continuous tubing apparatus of the present invention deployed on marine vessel 10 having deck area 11. In the preferred embodiment, the present invention comprises spool assembly 100. Said spool assembly 100 is rotatable about a central axis; in most cases, said spool assembly will be positioned so that said axis has a substantially horizontal orientation. The continuous tubing apparatus of the present invention is depicted as being deployed on marine vessel 10 in FIG. 1 for illustrative purposes; however, it is to be observed that the continuous tubing apparatus of the present invention can be utilized on many other vessels and/or installations (such as drilling rigs and the like), and such use is not limited exclusively to marine vessels as depicted in FIG. 1.

Still referring to FIG. 1, the present invention further comprises level-wind guide assembly 300. In the preferred embodiment, level-wind guide assembly 300 comprises a support frame 301 and at least one guide sheave 302. Said at least one guide sheave 302 directs continuous tubing 200 from spool assembly 100 toward a desired use—such as, for example, over side 12 of vessel 10 as depicted in FIG. 1. In the preferred embodiment depicted in FIG. 1, support frame 301 allows level-wind guide assembly 300 to be partially cantilevered over side 12 of vessel 10 to provide an unobstructed path for continuous tubing 200. In addition to directing continuous tubing 200 from spool assembly 100 off vessel 10, sheave 302 is capable of lateral movement to permit pay-out and take-up of continuous tubing 200 from spool assembly 100 in an orderly fashion as more fully described herein.

Still referring to FIG. 1, hydraulic power unit 500 is driven by either an electric motor or diesel engine, and provides the power necessary to drive rotation of spool assembly 100 (as well as the brake system for said spool assembly), and operation of level-wind guide assembly 300, as well as any other functions of the system of the present invention. A control system is either mounted directly to hydraulic power unit 500, is part of a remote operating panel 400 as depicted in FIG. 1, or comprises a combination of the two.

Figure 2:
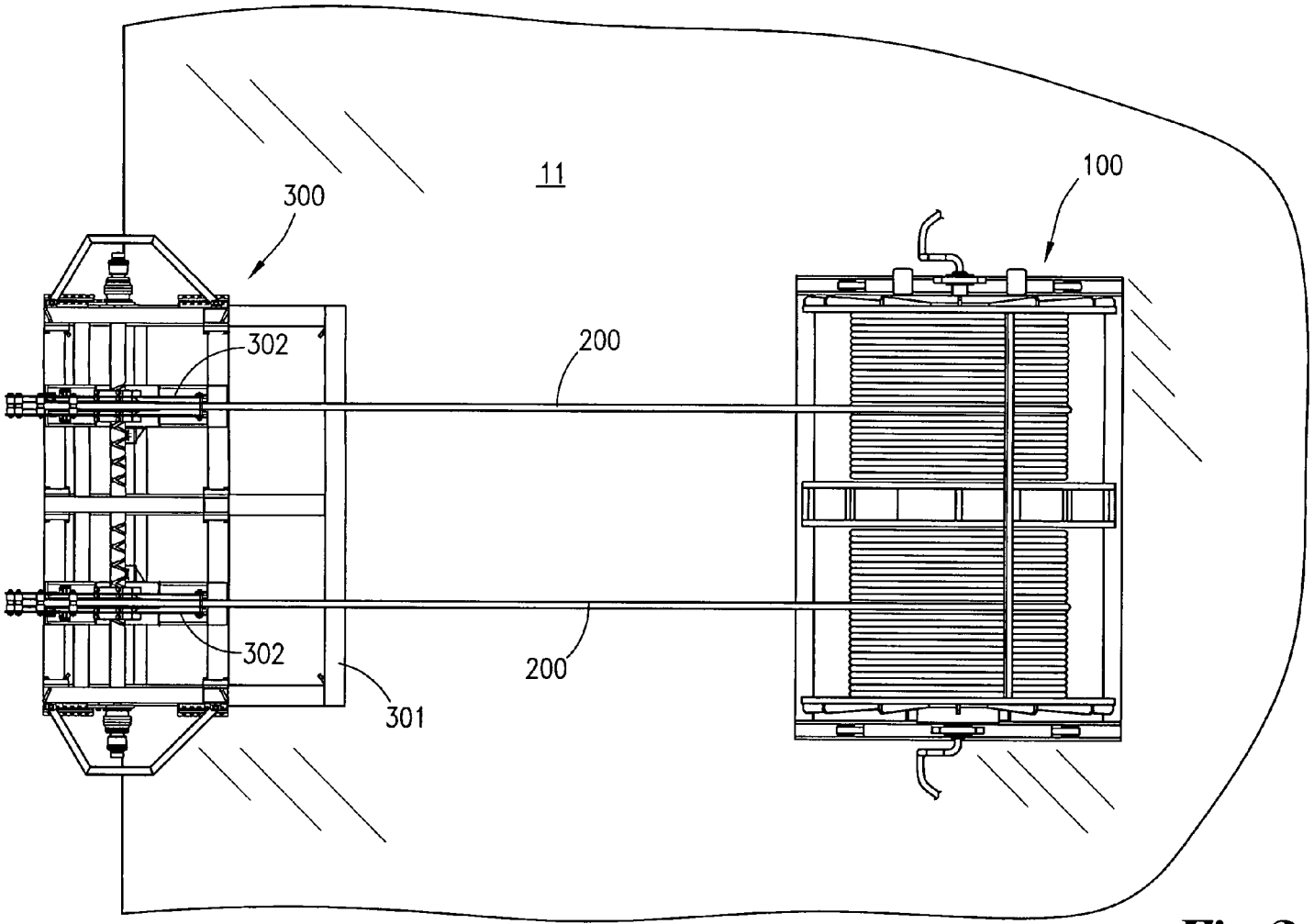
FIG. 2 depicts an overhead view of the continuous tubing apparatus of the present invention deployed on a marine vessel.

FIG. 2 depicts an overhead view of the continuous tubing apparatus of the present invention deployed on deck 11 of a marine vessel. In the preferred embodiment, the present invention comprises spool assembly 100 and level-wind guide assembly 300. Dual lengths of continuous tubing 200 are partially spooled on spool assembly 100. In the preferred embodiment depicted in FIG. 2, level-wind guide assembly 300 further comprises support frame 301 and dual guide sheaves 302. Said guide sheaves 302 function to direct lengths of continuous tubing 200 from spool assembly 100 to a desired use. Sheaves 302 are capable of lateral movement to permit pay-out and take-up of continuous tubing 200 in an orderly fashion as more fully described herein.

Figure 3:
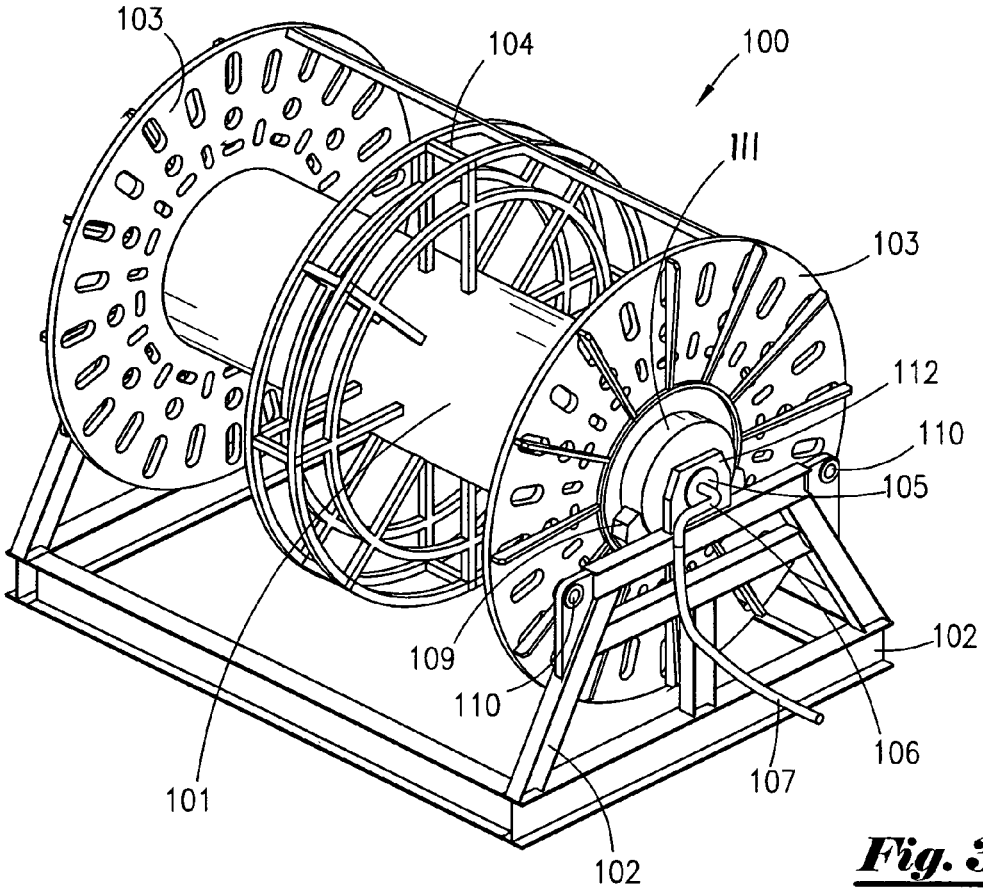
FIG. 3 depicts a perspective view of the spool assembly of the present invention.

FIG. 3 depicts a perspective view of spool assembly 100 of the present invention. In the preferred embodiment, spool assembly 100 comprises substantially cylindrical central drum 101 disposed on main shaft 105, which is in turn rotatably mounted to support frame 102 using bearing assembly 112. Lifting eyes 110 are provided on support frame 102 for connection to a crane, hoist or other lifting device. Central drum 101 provides a substantially cylindrical body for the collection of at least one continuous tubing string (such as length of continuous tubing 200 depicted in FIG. 2). Substantially planar end members 103 are disposed at opposite ends of central drum 101 to form a take-up reel or spool. In the preferred embodiment, wherein the present invention is capable of accommodating multiple strings of continuous tubing, dividing member 104 is also provided on central drum 101. Referring back to FIG. 2, dividing member 104 acts as a barrier to separate said multiple strings of continuous tubing.

Still referring to FIG. 3, hose 107 is connected to swivel outlet 106. Swivel outlet 106 permits fluid communication between hose 107 and a continuous tubing string spooled on central drum 101 in a manner well known to those having skill in the art. In this manner, fluids can be pumped from an outside source through hose 107, swivel outlet 106, into a continuous tubing string partially disposed on said central drum and out the distal end of said continuous tubing string, including while drum 101 is rotating. Alternatively, fluids can flow in the reverse direction; that is, fluids can flow into the distal end of a continuous tubing string, through swivel outlet 106 and, ultimately, out hose 107 to a tank or other fluid collection means. Brake member 111 and brake calipers 109 are provided to provide braking forces to central drum 101, and prevent rotation of said central drum 101, when desired.

Figure 4:
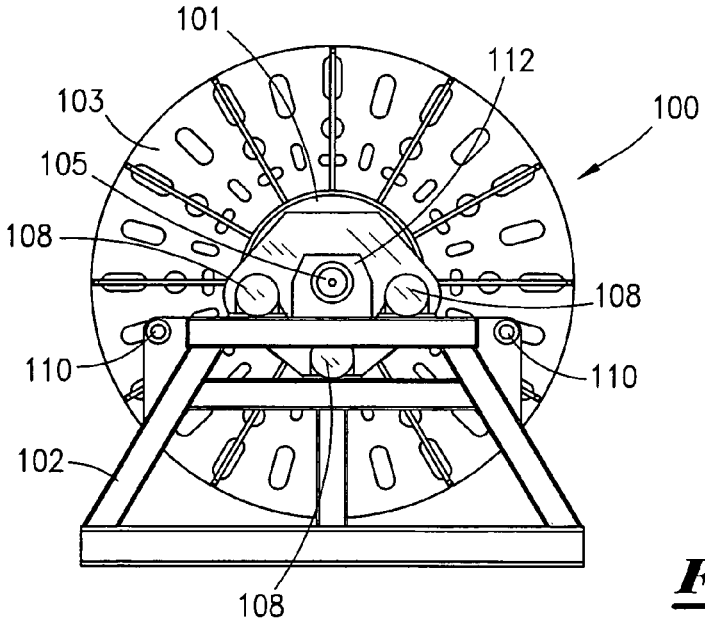
FIG. 4 depicts a side view of the spool assembly of the present invention.

FIG. 4 depicts a side view of the spool assembly 100 of the present invention from the opposite side as that depicted in FIG. 3. Spool assembly 100 comprises substantially cylindrical central drum 101 disposed on main shaft 105 (partially obscured from view in FIG. 4), which is in turn rotatably connected to support frame 102 using bearing assembly 112. Lifting eyes 110 are provided on support frame 102. Central drum 101 provides a spool for the collection of at least one length of continuous tubing, and can rotate about a substantially horizontal axis passing through said main shaft 105. Substantially planar end member 103 is disposed at or near an end of central drum 101. Drive motors 108 are provided to power rotation of drum 101 about main shaft 105.

Figure 5:
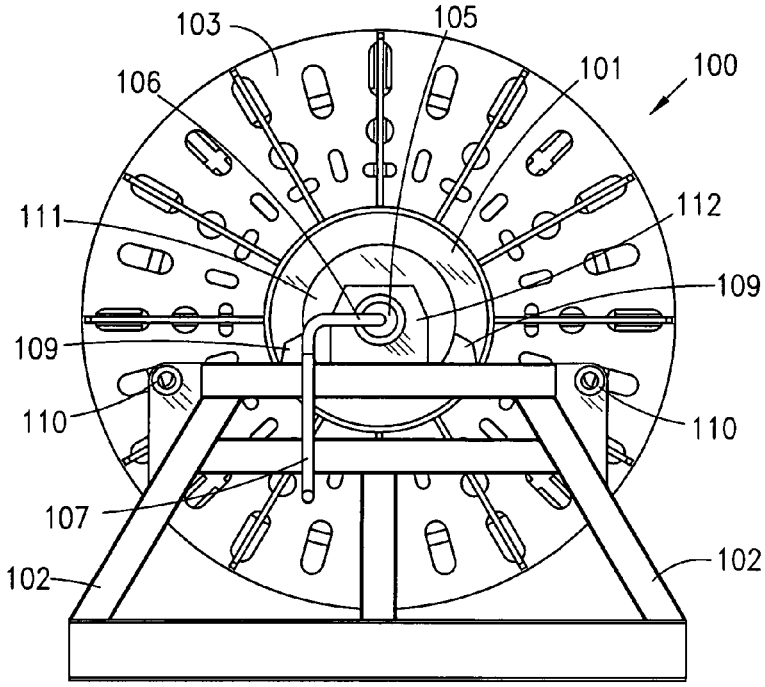
FIG. 5 depicts a side view of the spool assembly of the present invention.

FIG. 5 depicts a side view of spool assembly 100 of the present invention from the opposite side as the side depicted in FIG. 4. Spool assembly 100 comprises substantially cylindrical central drum 101 disposed on main shaft 105, which is in turn rotatably connected to support frame 102 using bearing assembly 112. Lifting eyes 110 are provided on support frame 102. Central drum 101 provides a substantially cylindrical spool for the collection of at least one length of continuous tubing, and can rotate about a substantially horizontal axis passing through main shaft 105. Substantially planar end member 103 is disposed at or near an end of central drum 101. Brake disk 111 and brake calipers 109 are also provided to apply braking forces to prevent rotation of central drum 101 when desired.

Still referring to FIG. 5, hose 107 is connected to swivel outlet 106. Swivel outlet 106 permits fluid communication between hose 107 and a length of continuous tubing spooled on central drum 101 (such as, for example, continuous tubing string 200 depicted in FIG. 2) in a manner well known to those having skill in the art. In this manner, fluids can be pumped from an outside source through hose 107, through swivel outlet 106, into such continuous tubing string disposed on said central drum 101 and out the distal end of said continuous tubing string, including while central drum 101 is being rotated. Alternatively, fluids can flow in the reverse direction, such that fluids can flow into the distal end of a length of continuous tubing, through swivel outlet 106 and, ultimately, out hose 107.

Figure 6:
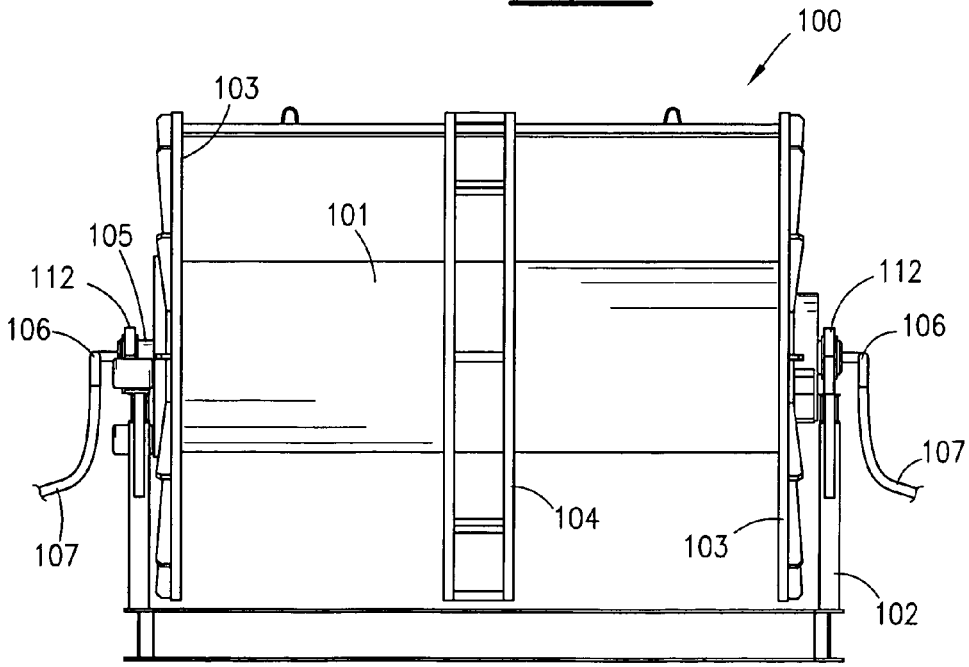
FIG. 6 depicts a rear view of the spool assembly of the present invention.

FIG. 6 depicts a rear view of spool assembly 100 of the present invention with no lengths of continuous tubing spooled on central drum 101. Spool assembly 100 comprises substantially cylindrical central drum 101 disposed on main shaft 105, which is in turn rotatably connected to support frame 102 using bearing assemblies 112. Central drum 101 provides a spool for the collection of at least one length of continuous tubing (not depicted in FIG. 6). Substantially planar end members 103 are disposed at opposite ends of central drum 101 to form a take-up reel or spool. In the preferred embodiment, wherein the present invention is capable of accommodating multiple strings of continuous tubing, dividing member 104 is also provided on central drum 101 and acts as a barrier to separate said multiple strings of continuous tubing. Hoses 107 are connected to swivel outlets 106, which permit fluid communication between hoses 107 and lengths of continuous tubing spooled on central drum 101 (not shown in FIG. 6).

Figure 7:
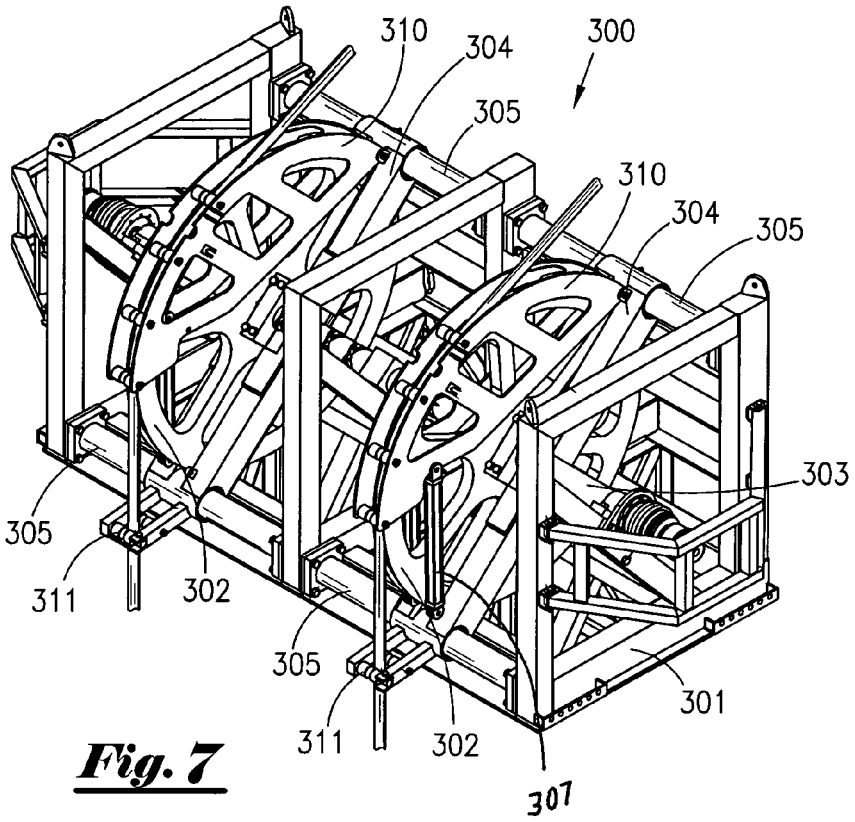
FIG. 7 depicts a perspective view of the level-wind guide assembly of the present invention.

FIG. 7 depicts a perspective view of a level-wind guide assembly 300 of the present invention. Level-wind guide assembly 300 comprises support frame 301. Lead screw shaft 303 is rotatably connected to support frame 301. Guide sheaves 302 are rotatably mounted within sheave support assemblies 304, which are in turn mounted to said lead screw shaft 303. Sheave support assemblies 304 are slidably disposed on guide rods 305, and each sheave support assembly can move laterally (and independently) along the length of said guide rods 305.

Figure 8:
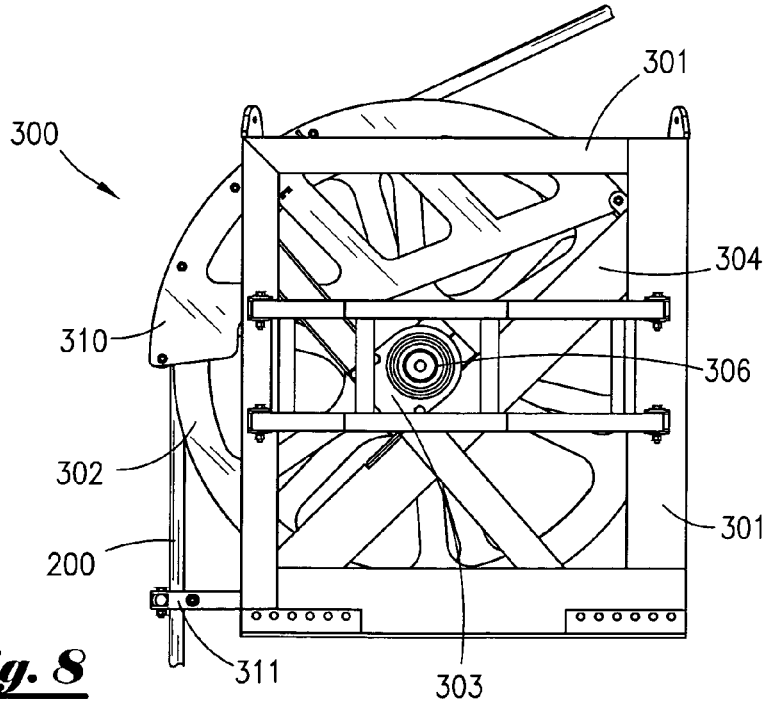
FIG. 8 depicts a side view of the level-wind guide assembly of the present invention.

FIG. 8 depicts a side view of the level-wind guide assembly 300 of the present invention. Lead screw shaft 303 is rotatably connected to support frame 301. Guide sheaves 302 are rotatably mounted within sheave support assemblies 304 (not shown in FIG. 8), which are mounted to said lead screw shaft 303. Level-wind motor 306 is used to power lead screw shaft 303.

Figure 9:
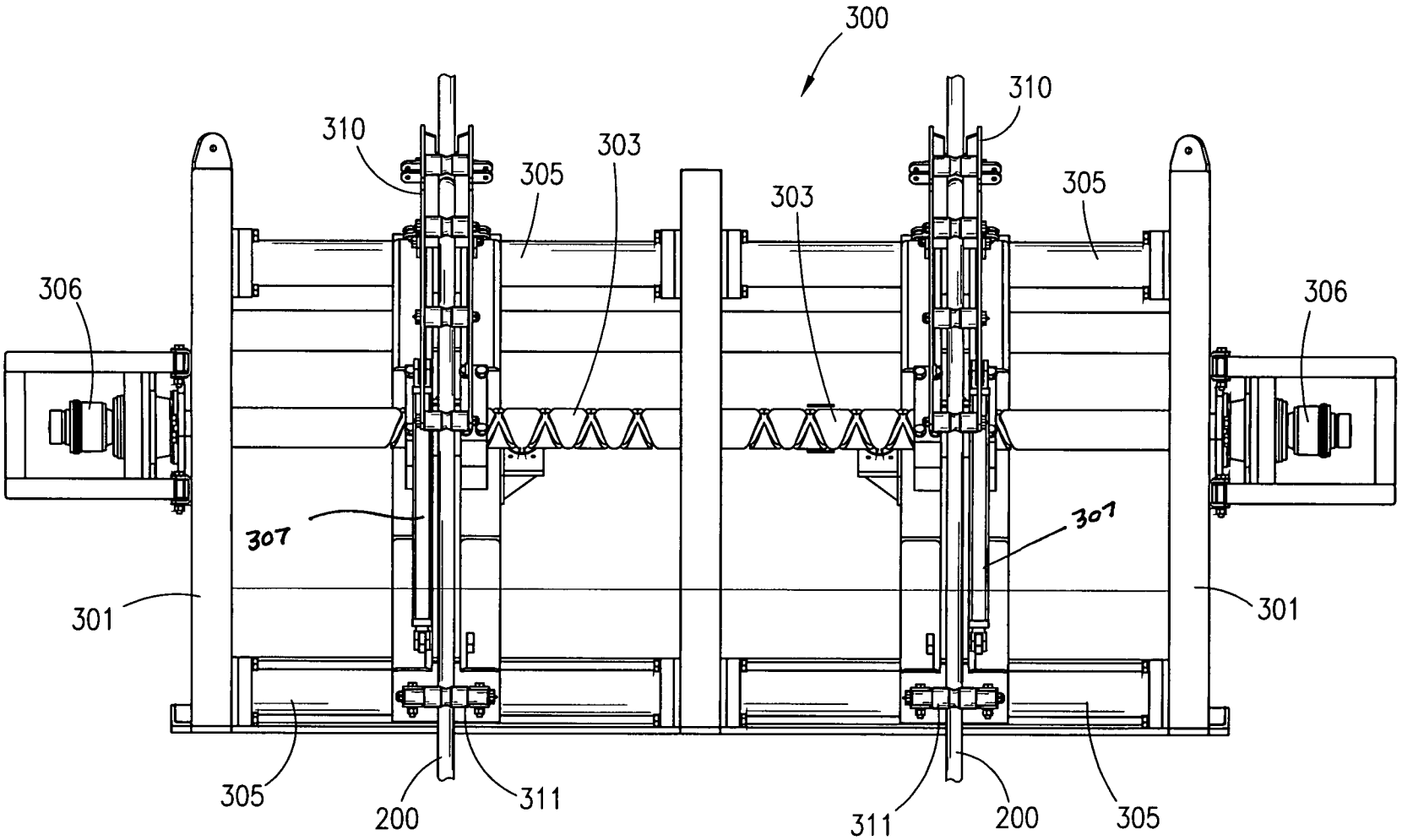
FIG. 9 depicts a front view of the level-wind guide assembly of the present invention.

FIG. 9 depicts a front view of the level-wind guide assembly 300 of the present invention. Lead screw shaft 303 is rotatably connected to support frame 301. Guide sheaves 302 are rotatably mounted within sheave support assemblies 304, which are in turn mounted to lead screw shaft 303. Sheave support assemblies 304 are slidably disposed on guide rods 305, and can move laterally along said guide rods 305.

Referring to FIGS. 7 through 9, level-wind guide assembly 300 of the present invention further comprises trap roller assembly 310 that can be lowered over sheave 302 to ensure that tubing 200 does not exit the central groove of each sheave 302. Trap roller assembly 310 can be raised and lowered with hydraulic cylinders 307. Said stationary trap roller assembly 310 guides the continuous tubing 200, and also serves as a surface for resting a clamp placed around tubing 200 when tension is applied to said tubing 200 in order to remove a tension weight and still keep tubing 200 in a controlled position. Said trap roller assembly 310 also has multiple locations that can accommodate placement of a counter device to record the length of tubing deployed or retrieved. Guide members 311 extend outward from level-wind guide assembly and serve to guide and/or direct tubing 200 leaving sheaves 302.

In operation, lateral movement of guide sheaves 302 is accomplished by the actuation of hydraulic motors 306 attached to lead screw 303 that rotates through the center of guide sheaves 302, thereby applying force to level-wind pawls that are attached to following carriers on the guide sheaves 302. In the preferred embodiment, hydraulic motors 306 are powered by fluid pumped from a hydraulic source mounted on spool assembly 100.

In the preferred embodiment, each revolution of drum 101 moves guide sheaves 302 laterally a distance equal to the diameter of continuous tubing 200. In the event that it is necessary to manually control the side to side movement of one or both guide sheave 302 a manual override system allows for bypass of the spool mounted hydraulic motor supply for one or both sheave level-wind motors and use fluid power from the hydraulic power unit to manually actuate the level-wind motors and move the sheave(s) to the desired position(s) before reverting back to automatic operation.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An apparatus for conducting continuous tubing operations comprising:

a. a spool member having first and second sides, wherein said spool member is rotatable about a substantially horizontal axis;

b. a first pump-in swivel member connected to said first side of said spool member;

c. a second pump-in swivel member connected to said second side of said spool member;

d. a motor connected to said spool member for rotating said spool member about a substantially horizontal axis;

e. a level-wind guide assembly detached from said spool member comprising:

i. a support frame; and ii. at least two sheaves, wherein said at least two sheaves are mounted to said support frame in substantially parallel orientation, and are rotatable about a substantially horizontal axis;

f. a first length of continuous flexible tubing having a first end and a second end, wherein said first end of said first length of continuous flexible tubing is connected to a first swivel pump-in member, a portion of said tubing between said first and second ends is disposed on said spool member, wherein said second end of said first length of continuous flexible tubing extends off said spool member, is disposed over a sheave of said level-wind guide assembly, and can be extended or retracted without use of an injector; and g. a second length of continuous flexible tubing having a first end and a second end, wherein said first end of said second length of continuous flexible tubing is connected to a second swivel pump-in member, a portion of said tubing between said first and second ends is disposed on said spool member, wherein said second end of said second length of continuous flexible tubing extends off said spool, is disposed over a sheave of said level-wind guide assembly, and can be extended or retracted without use of an injector.

2. The apparatus of claim 1, further comprising a brake apparatus connected to said spool apparatus.

3. The apparatus of claim 1, wherein said level-wind guide assembly further comprises:

a. at least two lead screw shafts rotatably connected to said support frame;

b. at least two sheave support assemblies mounted to said lead screw shaft;

c. at least two motors; and d. means for transferring torque from said motors to said lead screw shafts.

4. The apparatus of claim 3, wherein said means for transferring torque from said motors to said lead screw shafts is a belt or chain.

5. The apparatus of claim 1, further comprising a trap roller assembly disposed on each of said sheaves.

* * * * *